US008649545B2

(12) United States Patent
Tanaka et al.

(10) Patent No.: US 8,649,545 B2
(45) Date of Patent: Feb. 11, 2014

(54) MICROPHONE UNIT

(75) Inventors: Fuminori Tanaka, Osaka (JP); Ryusuke Horibe, Osaka (JP); Takeshi Inoda, Osaka (JP); Rikuo Takano, Ibaraki (JP); Kiyoshi Sugiyama, Tokyo (JP); Toshimi Fukuoka, Kanagawa (JP); Masatoshi Ono, Ibaraki (JP)

(73) Assignees: Funai Electric Co. Ltd., Osaka (JP); Funai Electric Advanced Applied Technology Research Institute Inc., Osaka (JP)

( * ) Notice: Subject to any disclaimer, the term of this patent is extended or adjusted under 35 U.S.C. 154(b) by 454 days.

(21) Appl. No.: 12/866,794

(22) PCT Filed: Feb. 6, 2009

(86) PCT No.: PCT/JP2009/052026
§ 371 (c)(1),
(2), (4) Date: Mar. 15, 2011

(87) PCT Pub. No.: WO2009/099168
PCT Pub. Date: Aug. 13, 2009

(65) Prior Publication Data

US 2011/0158450 A1 Jun. 30, 2011

(30) Foreign Application Priority Data

Feb. 8, 2008 (JP) ..... 2008-029573

(51) Int. Cl.
*H04R 25/00* (2006.01)

(52) U.S. Cl.
USPC ..... 381/355; 381/357; 381/358; 381/369

(58) Field of Classification Search
USPC ..... 381/351, 355–360, 369, 170–182
See application file for complete search history.

(56) References Cited

U.S. PATENT DOCUMENTS

2003/0165251 A1 9/2003 Pribyl
2004/0202345 A1 10/2004 Stenberg et al.

FOREIGN PATENT DOCUMENTS

CN 1441621 A 9/2003
EP 1870687 A1 12/2007

(Continued)

OTHER PUBLICATIONS

Office Action issued in corresponding Chinese Application No. 200980104543.5 dated Oct. 10, 2012, and English translation thereof (14 pages).

(Continued)

*Primary Examiner* — Davetta W Goins
*Assistant Examiner* — Jasmine Pritchard
(74) *Attorney, Agent, or Firm* — Osha Liang LLP

(57) ABSTRACT

To provide a downsized microphone unit in which a differential microphone is densely mounted thereon.
The microphone unit has a cover portion 30 and a microphone substrate 10, in which a first substrate internal space 15 is communicated with a cover portion internal space 32 via a first substrate opening 11 and a cover portion opening 31, and is communicated with the outside via a second substrate opening 12, a second substrate internal space 16 is communicated with the cover portion internal space 32 via a third substrate opening 13 and a cover portion opening 31, and is communicated with the outside via a fourth substrate opening 14, a partition portion 20 covers a communication aperture between the first substrate opening 11 and the cover portion opening 31, and a diaphragm 22 covers at least a part of the communication aperture between the first substrate opening 11 and the cover portion opening 31.

10 Claims, 6 Drawing Sheets

(56) References Cited

FOREIGN PATENT DOCUMENTS

| | | | |
|---|---|---|---|
| EP | 1978779 | A2 | 10/2008 |
| GB | 2436460 | A | 9/2007 |
| JP | 2005-295278 | A | 10/2005 |
| JP | 2007-060661 | A | 3/2007 |
| JP | 2007-081614 | A | 3/2007 |
| JP | 2007-150507 | A | 6/2007 |
| JP | 2007-306125 | A | 11/2007 |

OTHER PUBLICATIONS

International Search Report w/translation from PCT/JP2009/052026 dated Apr. 7, 2009 (4 pages).

Extended European Search Report issued in corresponding European Application No. 09708575.7 dated Jun. 8, 2012 (7 pages).

MICROPHONE UNIT

TECHNICAL FIELD

The present invention relates to a microphone unit.

BACKGROUND ART

At the time of speaking by telephone, speech recognition, speech recording, and the like, it is preferable to collect only target speech (the voice of a speaker). However, in some cases, a sound other than a target speech such as a background noise exists depending on the usage environment of a speech input device. Therefore, the development of a speech input device having a function which enables to accurately extract a target speech, i.e., which cancels the noise even in a case where the device is used in an environment with a noise, has been advanced.

Further, in recent years, the downsizing of electronics has been advanced, and a technology for downsizing a speech input device has become important.

Patent Document 1: JP-A-2007-81614

DISCLOSURE OF THE INVENTION

Problem to be Solved by the Invention

As a close-talking microphone suppressing a distant noise, a differential microphone which generates a differential signal indicating a difference between voltage signals from two microphones to utilize the differential signal is known. Meanwhile, since such a differential microphone uses two microphones, it is difficult to downsize the microphone unit with the differential microphone densely mounted thereon.

The present invention has been achieved in consideration of the above-described circumstances. An object of the present invention is to provide a microphone unit downsized by densely mounting a differential microphone thereon.

Means for Solving the Problem (1) A microphone unit according to the present invention including a microphone substrate, a partition portion including a diaphragm, and a cover portion which covers one surface side of the microphone substrate, in which the cover portion has a cover portion opening provided in one surface, and a cover portion internal space communicated with the outside via the cover portion opening, the microphone substrate has a first substrate opening and a third substrate opening which are provided in one surface, a second substrate opening and a fourth substrate opening which are provided in the other surface, and a first substrate internal space and a second substrate internal space, the first substrate internal space is communicated with the cover portion internal space via the first substrate opening and the cover portion opening, and is communicated with the outside via the second substrate opening, the second substrate internal space is communicated with the cover portion internal space via the third substrate opening and the cover portion opening, and is communicated with the outside via the fourth substrate opening, the partition portion covers a communication aperture between the first substrate opening and the cover portion opening, and the diaphragm covers at least a part of the communication aperture between the first substrate opening and the cover portion opening.

The partition portion may be configured as a so-called MEMS (MEMS: Micro Electro Mechanical Systems). Further, the diaphragm may be a diaphragm performing acoustic-to-electric conversion due to a piezoelectric effect by use of an inorganic piezoelectric thin film or an organic piezoelectric thin film, or an electret film may be used as a diaphragm. Further, the microphone substrate may be configured with a material such as an insulation molding base material, sintered ceramics, glass-epoxy, or plastic.

According to the present invention, it is possible to realize a microphone unit in which a differential microphone composed of one diaphragm is densely mounted thereon.

(2) In the microphone unit, the cover portion internal space may be provided in the vertical direction of the cover portion opening.

(3) In the microphone unit, the first substrate internal space may be provided in the vertical direction of the first substrate opening.

(4) In the microphone unit, the first substrate internal space may be provided in the vertical direction of the second substrate opening.

(5) In the microphone unit, the first substrate internal space may be provided at a position at which the first substrate internal space is not overlapped with the vertical direction of the second substrate opening, the second substrate opening may be provided at a position at which the second substrate opening is not overlapped with the vertical direction of the first substrate opening.

(6) The microphone unit may include a signal processing circuit disposed on one surface side of the microphone substrate inside the cover portion internal space.

(7) The microphone unit may include an electrode unit electrically connected to the signal processing circuit on the other surface side of the microphone substrate.

(8) In the microphone unit, wherein a sound wave arrival time from the second substrate opening to the diaphragm and a sound wave arrival time from the fourth substrate opening to the diaphragm may be made equal.

(9) The microphone unit including a wiring board having a first through hole and a second through hole, wherein the wiring board may be disposed at a position at which the first through hole is communicated with the first substrate internal space via the second substrate opening, and the second through hole is communicated with the second substrate internal space and the cover portion internal space via the fourth substrate opening.

(10) In the microphone unit, an area surrounding the first through hole on one surface of the wiring board and an area surrounding the second opening on the other surface of the microphone substrate may be connected so as to face each other, and an area surrounding the second through hole on one surface of the wiring board and an area surrounding the fourth opening on the other surface of the microphone substrate may be connected so as to face each other.

DESCRIPTION OF REFERENCE NUMERALS

1 to 4 microphone unit, 10: microphone substrate, 11: first substrate opening, 12, 42: second substrate opening, 13: third substrate opening, 14: fourth substrate opening, 15, 25, 35, 45: first substrate internal space, 16, 26, 36, 46: second substrate internal space, 17 to 19: microphone substrate, 20: partition portion, 22: diaphragm, 24: holding portion, 30: cover portion, 31: cover portion opening, 32: cover portion internal space, 40: signal processing circuit, 51 to 54: electrode, 60: wiring board, 71 to 72: sealing portion, 81: first through hole, 82: second through hole, 200: condenser microphone, 202: diaphragm, 204: electrode

Best Modes for Carrying Out the Invention

Hereinafter, an embodiment to which the present invention is applied will be described with reference to the drawings. However, the present invention is not limited to the following embodiments. Further, the present invention includes the freely-combined following content.

In addition, microphone units which will be described hereinafter may be applied to, for example, mobile telephones, public telephones, speech communication devices such as transceivers or head sets, or recording devices, amplification systems (loudspeakers), microphone systems, and the like.

1. Microphone Unit According to a First Embodiment

Figure 1:
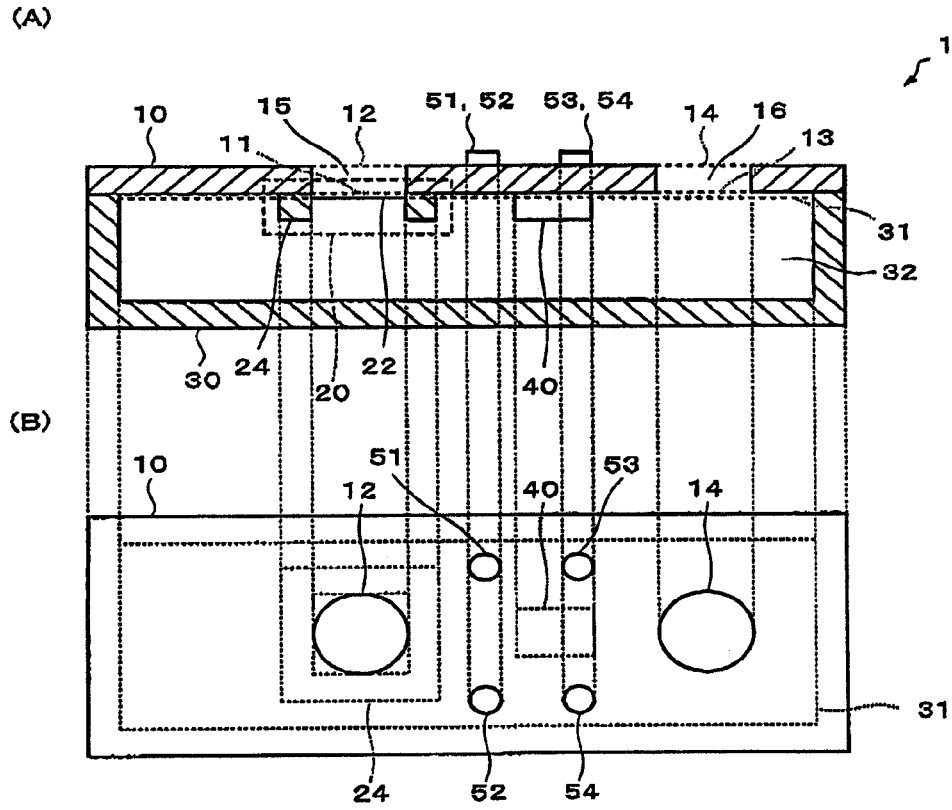
FIG. 1 is the configuration of a microphone unit according to a first embodiment.
Figure 2:
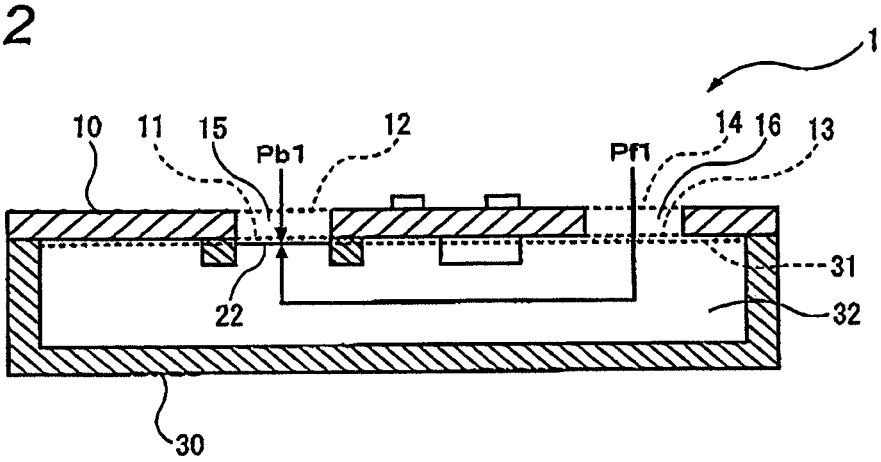
FIG. 2 is a cross sectional view for explanation of the operation of the microphone unit according to the first embodiment.
Figure 3:
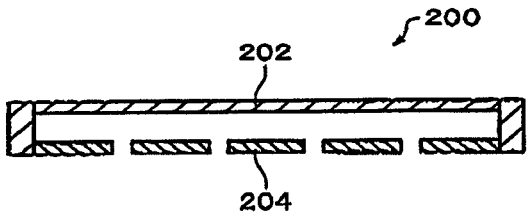
FIG. 3 is the configuration of a condenser microphone.

The configuration of a microphone unit 1 according to a first embodiment will be described with reference to FIGS. 1 to 3.

FIGS. 1(A) and 1(B) are views showing one example of the configuration of the microphone unit according to the present embodiment. FIG. 1(A) is a cross sectional view of the microphone unit 1 according to the present embodiment, and FIG. 1(B) is a view schematically showing a plan view of the microphone unit 1 according to the present embodiment.

The microphone unit 1 according to the present embodiment includes a microphone substrate 10, a partition portion 20, and a cover portion 30.

The cover portion 30 is configured to cover one surface side of the microphone substrate 10. Further, the cover portion 30 has a cover portion opening 31 provided in its one surface, and a cover portion internal space 32 communicating with the outside of the cover portion via the cover portion opening 31. The cover portion internal space 32 may be provided only in the vertical direction of the cover portion opening 31.

The shape of the cover portion internal space 32 is not particularly limited. For example, it may be formed a rectangular parallelepiped shape. Further, the shape of the cover portion opening 31 is not particularly limited. For example, it may be formed a rectangular shape. In the case where the cover portion internal space 32 is a rectangular parallelepiped, the cover portion opening 31 may be disposed over an entire surface of the cover portion internal space 32.

The microphone substrate 10 has a first substrate opening 11 and a third substrate opening 13 which are provided in one surface, a second substrate opening 12 and a fourth substrate opening 14 which are provided in the other surface, and a first substrate internal space 15 and a second substrate internal space 16.

The first substrate internal space 15 is communicated with the cover portion internal space 32 via the first substrate opening 11 and the cover portion opening 31, and is communicated with the outside via the second substrate opening 12.

The second substrate internal space 16 is communicated with the cover portion internal space 32 via the third substrate opening 13 and the cover portion opening 31, and is communicated with the outside via the fourth substrate opening 14.

The shapes of the first substrate internal space 15 and the second substrate internal space 16 are not particularly limited. For example, they may be formed a rectangular parallelepiped or a cylindrical shape as in the present embodiment Further, the shapes of the first substrate opening 11, the second substrate opening 12, the third substrate opening 13, and the fourth substrate opening 14 are not particularly limited. For example, they may be formed a circular shape or a rectangular shape as in present embodiment. Moreover, the shapes of the first substrate opening 11 and the second substrate opening 12, the third substrate opening 13 and the fourth substrate opening 14 may be respectively formed in the same shape as in the present embodiment.

Further, the first substrate internal space 15 may be provided only in the vertical direction of the first substrate opening 11 and the second substrate opening 12 as in the present embodiment. Similarly, the second substrate internal space 16 may be provided only in the vertical direction of the third substrate opening 13 and the fourth substrate opening 14 as in the present embodiment.

In addition, the microphone substrate 10 may be formed of a material such as an insulation molding base material, sintered ceramics, glass-epoxy, or plastic.

The partition portion 20 is disposed at a position so as to cover a communication aperture between the first substrate opening 11 and the cover portion opening 31. That is, in the microphone unit 1 according to the present embodiment, the first substrate internal space 15 and the cover portion internal space 32 are partitioned by the partition portion 20, so as not to be communicated with each other.

The partition portion 20 includes a diaphragm 22 as a part thereof. The diaphragm 22 is a member vibrating in the nominal line direction when a sound wave is incident thereto. Then, in the microphone unit 1, an electrical signal indicating a speech incident to the diaphragm 22 is acquired by extracting an electrical signal on the basis of vibration of the diaphragm 22. That is, the diaphragm 22 is a diaphragm of the microphone.

The diaphragm 22 is disposed at a position so as to cover a part of the substrate opening 11. In addition, the position of the vibrating surface of the diaphragm 22 may be or may not be matched to the aperture plane of the first substrate opening 11. Further, the partition portion 20 may have a holding portion 24 that holds the diaphragm 22.

Hereinafter, the configuration of a condenser microphone 200 will be described as an example of a microphone which is applicable to the present embodiment. FIG. 3 is a cross sectional view schematically showing the configuration of the condenser microphone 200.

The condenser microphone 200 has a diaphragm 202. In addition, the diaphragm 202 corresponds to the diaphragm 22 in the microphone unit 1 according to the present embodiment. The diaphragm 202 is a film (thin film) receiving a sound wave to vibrate, which has electrical conductivity and forms one end of an electrode. The condenser microphone 200 further has an electrode 204. The electrode 204 is disposed so as to face and be close to the diaphragm 202. Accordingly, the diaphragm 202 and the electrode 204 form a capacitance. When a sound wave is incident to the condenser microphone 200, the diaphragm 202 vibrates, and an interval between the diaphragm 202 and the electrode 204 changes, which changes an electrostatic capacitance between the diaphragm 202 and the electrode 204. By retrieving the change in electrostatic capacitance as, for example, a change in voltage, it is possible to acquire an electrical signal based on vibration of the diaphragm 202. That is, it is possible to convert a sound wave incident to the condenser microphone 200 into an electrical signal, to output the electrical signal. In addition, in the condenser microphone 200, the electrode 204 may be configured so as not to be affected by a sound wave. For example, the electrode 204 may have a mesh structure.

However, the microphone (diaphragm 22) which is applicable to the present invention is not limited to a condenser microphone, and any microphone which has already become publicly known may be applied. For example, the diaphragm 22 may be a diaphragm for various sorts of microphones, such as electrodynamic (dynamic type), electromagnetic (magnetic type), piezoelectric (crystal type) microphones.

Or, the diaphragm 22 may be a semiconductor film (for example, a silicon film). That is, the diaphragm 22 may be a diaphragm for a silicon microphone (Si microphone). By using a silicon microphone, it is possible to downsize the microphone unit 1 and realize the microphone unit 1 with high performance.

In addition, the shape of the diaphragm 22 is not particularly limited. For example, the outer shape of the diaphragm 22 may be formed a circular shape.

The microphone unit 1 according to the present embodiment may include a signal processing circuit 40. The signal processing circuit 40 performs processing such as amplifying a signal based on vibration of the diaphragm 22. The signal processing circuit 40 may be disposed on one surface side of the microphone substrate 10 in the cover portion internal space 32. It is preferable that the signal processing circuit 0 is disposed close to the diaphragm 22. That is, in the case where a signal based on vibration of the diaphragm 22 is faint, it is possible to suppress the effect of an external electromagnetic noise as low as possible, to improve its SNR (Signal to Noise Ratio). Further, the signal processing circuit 40 is not limited to an amplifier circuit, and may be configured to have an AD converter or the like built-in, and carry out digital output.

The microphone unit 1 according to the present embodiment may include electrodes 51 to 54. The electrodes 51 to 54 electrically connect a wiring board or the like (not shown) and the signal processing circuit 40. In addition, FIG. 1(B) shows four cylindrical electrodes, meanwhile, the shapes and the number of the electrodes are not particularly limited.

Next, the operation of the microphone unit 1 according to the present embodiment will be described with reference to FIG. 2.

A sound pressure Pf1 of a sound wave which is incident from the fourth substrate opening 14 to reach the diaphragm 22 through the second substrate internal space 16 and the cover portion internal space 32 is incident to one side of the diaphragm 22, and a sound pressure Pb1 of a sound wave which is incident from the second substrate opening 12 to reach the diaphragm 22 through the first substrate internal space 15 is incident to the other side of the diaphragm 22. Therefore, the diaphragm 22 vibrates on the basis of a difference between the sound pressure Pf1 and the sound pressure Pb1. That is, the diaphragm 22 operates as a diaphragm for a differential microphone.

Here, in order to obtain satisfactory differential microphone characteristics, the adhesion between the microphone substrate 10 and the holding portion 24 is important. When there is an acoustic leakage between the microphone substrate 10 and the holding portion 24, it is impossible to transmit a sound pressure input from the second substrate opening 12 to the diaphragm 22, which makes it impossible to obtain satisfactory differential microphone characteristics. In the present embodiment, since all the four sides of the bottom surface (the top surface in the drawing) of the holding portion 24 holding the diaphragm 22 are closely adhered to the top surface (the bottom surface in the drawing) of the microphone substrate 10 in the first substrate opening 11, by implementation of an acoustic leakage countermeasure with a sealing material or the like onto this one surface, it is possible to obtain satisfactory differential microphone characteristics without variation, which makes it possible to obtain a microphone unit resistant to environmental changes as well.

Therefore, according to the microphone unit 1 in the present embodiment, it is possible to detect a sound pressure difference by use of sound waves at two points on the same surface of the microphone substrate 10 as inputs. Further, it is possible to realize a small-sized and lightweight microphone unit by densely mounting a differential microphone composed of one diaphragm thereon.

Further, since the second substrate opening 12 and the fourth substrate opening 14 function as sound collecting apertures, and the electrodes 51 to 54 are on the same surface side of the microphone substrate 10, it is possible to realize a microphone unit which can be disposed on the back side of the wiring board.

2. Microphone Unit According to a Second Embodiment

Figure 4:
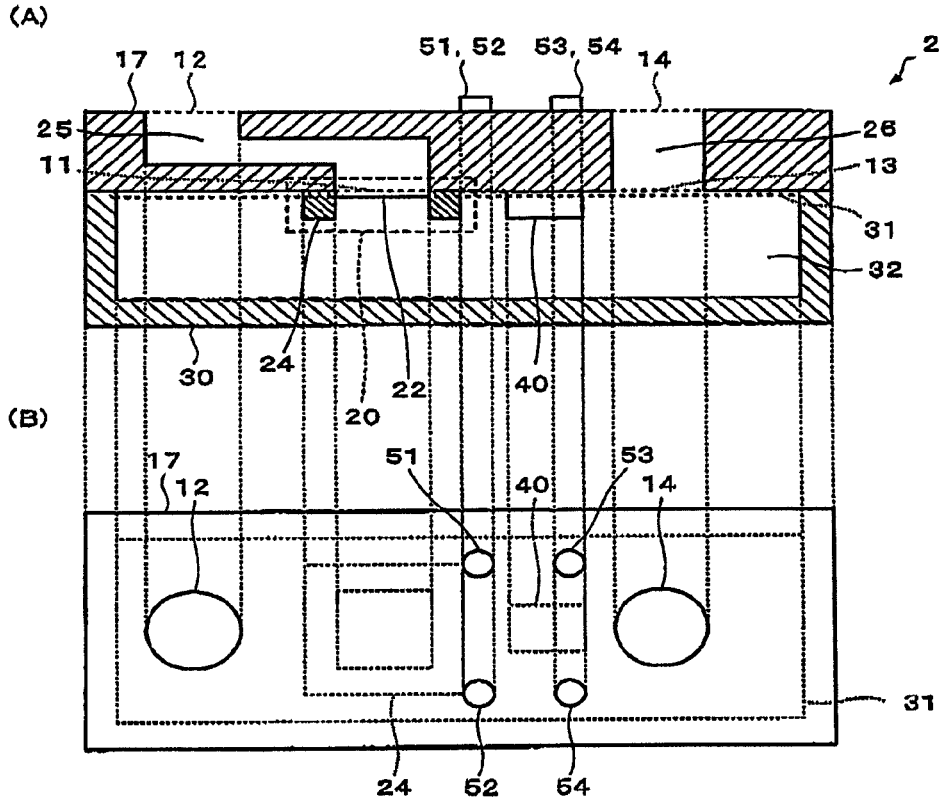
FIG. 4 is the configuration of a microphone unit according to a second embodiment.
Figure 5:
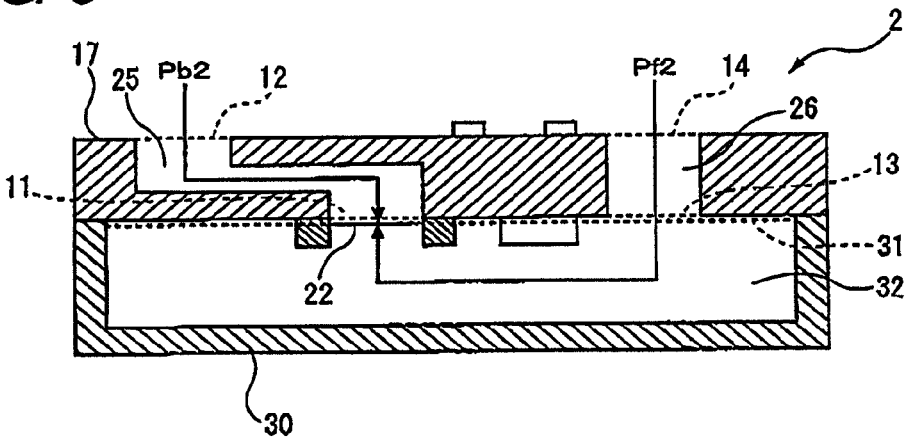
FIG. 5 is a cross sectional view for explanation of the operation of the microphone unit according to the second embodiment.

The configuration of a microphone unit 2 according to a second embodiment will be described with reference to FIGS. 4 and 5.

FIGS. 4(A) and 4(B) are views showing one example of the microphone unit according to the present embodiment. FIG. 4(A) is a cross sectional view of the microphone unit 2 according to the present embodiment, and FIG. 4(B) is a view schematically showing a plan view of the microphone unit 2 according to the present embodiment. In addition, configurations which are the same as those in the microphone unit 1 described with reference to FIGS. 1(A) and 1(B) are attached with the same reference numerals, and detailed descriptions thereof will be omitted.

The microphone unit 2 according to the present embodiment includes a microphone substrate 17, the partition portion 20, and the cover portion 30. The configurations of the partition portion 20 and the cover portion 30 are the same as those in the microphone unit 1 described with reference to FIGS. 1(A) and 1(B).

The microphone substrate 17 has the first substrate opening 11 and the third substrate opening 13 which are provided in one surface, the second substrate opening 12 and the fourth substrate opening 14 which are provided in the other surface, and a first substrate internal space 25 and a second substrate internal space 26.

The first substrate internal space 25 is communicated with the cover portion internal space 32 via the first substrate opening 11 and the cover portion opening 31, and is communicated with the outside via the second substrate opening 12.

The second substrate internal space 26 is communicated with the cover portion internal space 32 via the third substrate opening 13 and the cover portion opening 31, and is communicated with the outside via the fourth substrate opening 14.

The shapes a the first substrate internal space 25 and the second substrate internal space 26 are not particularly limited. For example, they may be formed a rectangular parallelepiped or a cylindrical shape. Further, the shapes of the first substrate opening 11, the second substrate opening 12, the third substrate opening 13, and the fourth substrate opening 14 are not particularly limited. For example, they may be formed a circular shape or a rectangular shape. Moreover, the shapes of the first substrate opening 11 and the second substrate opening 12, the third substrate opening 13 and the fourth substrate opening 14 may be respectively formed the same shape.

The first substrate internal space 25 may be provided at a position at which the first substrate internal space 25 is not overlapped with the vertical direction of the second substrate opening 12 as in the present embodiment, and the second substrate opening 12 may be provided at a position at which the second substrate opening 12 is not overlapped with the vertical direction of the first substrate opening 11. Further, the second substrate internal space 16 may be provided only in the vertical direction of the third substrate opening 13 and the fourth substrate opening 14 as in the present embodiment.

In addition, the microphone substrate 17 may be formed of a material such as an insulation molding base material, sintered ceramics, glass-epoxy, or plastic. Further, the microphone substrate 17 having the first substrate internal space 25 and the second substrate internal space 26 can be manufactured, for example, by partially bonding a substrate having through holes and a substrate without through holes.

The microphone unit 2 according to the present embodiment may include the signal processing circuit 40 and the electrodes 51 to 54. The configurations of the signal processing circuit 40 and the electrodes 51 to 54 are the same as those in the microphone unit 1 described with reference to FIGS. 1(A) and 1(B).

Next, the operation of the microphone unit 2 according to the present embodiment will be described with reference to FIG. 5.

A sound pressure Pf2 of a sound wave which is incident from the fourth substrate opening 14 to reach the diaphragm 22 through the second substrate internal space 26 and the cover portion internal space 32, is incident to one side of the diaphragm 22, and a sound pressure Pb2 of a sound wave which is incident from the second substrate opening 12 to reach the diaphragm 22 through the first substrate internal space 25, is incident to the other side of the diaphragm 22. Therefore, the diaphragm 22 vibrates on the basis of a difference between the sound pressure Pf2 and the sound pressure Pb2. That is, the diaphragm 22 operates as a diaphragm for a differential microphone.

Here, in order to obtain satisfactory differential microphone characteristics, the adhesion between the microphone substrate 17 and the holding portion 24 is important. When there is an acoustic leakage between the microphone substrate 17 and the holding portion 24, it is impossible to transmit a sound pressure input from the second substrate opening 12 to the diaphragm 22, which makes it impossible to obtain satisfactory differential microphone characteristics. In the present embodiment, since all the four sides of the bottom surface (the top surface in the drawing) of the holding portion 24 holding the diaphragm 22 are closely adhered to the top surface (the bottom surface in the drawing) of the microphone substrate 17 in the first substrate opening 11, by implementation of an acoustic leakage countermeasure with a sealing material or the like onto this one surface, it is possible to obtain satisfactory differential microphone characteristics without variation, which makes it possible to obtain a microphone unit resistant to environmental changes as well.

Therefore, according to the microphone unit 2 in the present embodiment, it is possible to detect a sound pressure difference by use of sound waves at two points on the same surface of the microphone substrate 17 as inputs. Further, it is possible to realize a small-sized and lightweight microphone unit by densely mounting a differential microphone composed of one diaphragm thereon.

Further, since the second substrate opening 12 and the fourth substrate opening 14 function as sound collecting apertures, and the electrodes 51 to 54 are on the same surface side of the microphone substrate 17, it is possible to realize a microphone unit which can be disposed on the back side of the wiring board.

Moreover, the microphone unit may be configured such that a sound wave arrival time from the fourth substrate opening 14 to the diaphragm 22 and a sound wave arrival time from the second substrate opening 12 to the diaphragm 22 are made equal. The microphone unit may be configured such that a route length of a sound wave from the fourth substrate opening 14 to the diaphragm 22 and a route length of a sound wave from the second substrate opening 12 to the diaphragm 22 are made equal in order to equalize the sound wave arrival times. A route length may be, for example, a length of a line connecting centers of sections of a route. Preferably, a ratio between these route lengths is made equal by ±20% (within a range from 80% or more to 120% or less), to substantially equalize their acoustic impedances, which makes it possible to make a differential microphone characteristic especially in a high frequency band satisfactory.

With this configuration, since it is possible to arrange the arrival times of sound waves, i.e., the phases reaching the diaphragm 22 from the fourth substrate opening 14 and the second substrate opening 12, it is possible to realize a further accurate noise-canceling function.

3. Microphone Unit According to a Third Embodiment

Figure 6:
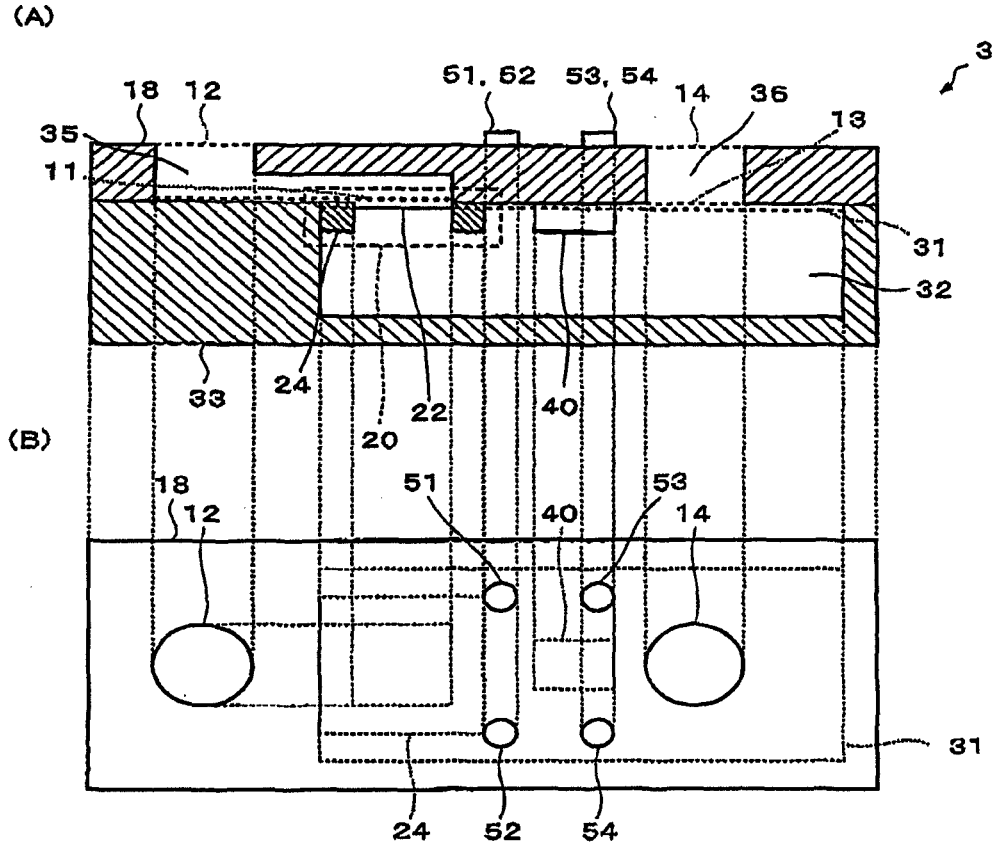
FIG. 6 are the configuration of a microphone unit according to a third embodiment.
Figure 7:
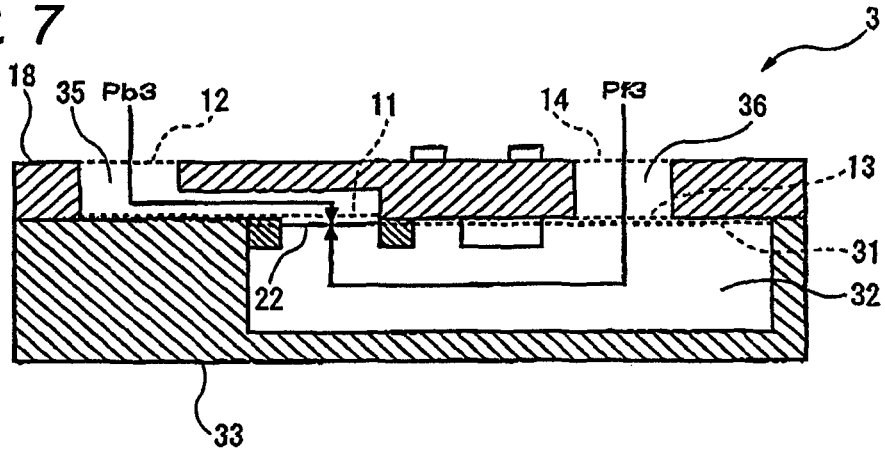
FIG. 7 is a cross sectional view for explanation of the operation of the microphone unit according to the third embodiment.

The configuration of a microphone unit 3 according to a third embodiment will be described with reference to FIGS. 6 and 7.

FIGS. 6(A) and 6(B) are views showing one example of the configuration of the microphone unit according to the present embodiment. FIG. 6(A) is a cross sectional view of the microphone unit 3 according to the present embodiment, and FIG. 6(B) is a view schematically showing a plan view of the microphone unit 3 according to the present embodiment. In addition, configurations which are the same as those in the microphone unit 1 described with reference to FIGS. 1(A) and 1(B) are attached with the same reference numerals, and detailed descriptions thereof will be omitted.

The microphone unit 3 according to the present embodiment includes a microphone substrate 18, the partition portion 20, and a cover portion 33.

The cover portion 33 is configured to cover one surface side of the microphone substrate 18. Further, the cover portion 33 has the cover portion opening 31 provided in its one surface, and the cover portion internal space 32 communicating with the outside of the cover portion via the cover portion opening 31. The cover portion internal space 32 may be provided only in the vertical direction of the cover portion opening 31.

The shape of the cover portion internal space 32 is not particularly limited. For example, it may be formed a rectangular parallelepiped shape. Further, the shape of the cover portion opening 31 is not particularly limited. For example, it may be formed a rectangular shape. In the case where the cover portion internal space 32 is a rectangular parallelepiped, the cover portion opening 31 may be disposed over an entire surface of the cover portion internal space 32.

The microphone substrate 18 has the first substrate opening 11 and the third substrate opening 13 which are provided in one surface, the second substrate opening 12 and the fourth substrate opening 14 which are provided in the other surface, and a first substrate internal space 35 and a second substrate internal space 36.

The first substrate internal space 35 is communicated with the cover portion internal space 32 via the first substrate opening 11 and the cover portion opening 31, and is communicated with the outside via the second substrate opening 12.

The second substrate internal space 36 is communicated with the cover portion internal space 32 via the third substrate opening 13 and the cover portion opening 31, and is communicated with the outside via the fourth substrate opening 14.

The shapes of the first substrate internal space 35 and the second substrate internal space 36 are not particularly limited. For example, they may be formed a rectangular parallelepiped or a cylindrical shape. Further, the shapes of the first substrate opening 11, the second substrate opening 12, the third substrate opening 13, and the fourth substrate opening 14 are not particularly limited. For example, they may be formed a circular shape or a rectangular shape as in the present embodiment. Moreover, the shapes of the third substrate opening 13 and the fourth substrate opening 14 may be respectively formed the same shape as in the present embodiment.

The first substrate internal space 35 may be provided only inside the substrate in the vertical direction of the first substrate opening 11 as in the present embodiment. Further, the second substrate internal space 36 may be provided only in the vertical direction of the third substrate opening 13 and the fourth substrate opening 14 as in the present embodiment.

In addition, the microphone substrate 18 may be formed of a material such as an insulation molding base material, sintered ceramics, glass-epoxy, or plastic. Further, the microphone substrate 18 having the first substrate internal space 35 and the second substrate internal space 36 can be, for example, manufactured by pressing a mold having a convex portion onto an insulation molding base material to form through holes thereafter, or manufactured from sintered ceramics by use of a desired mold to form through holes thereafter, or manufactured by bonding substrates having through holes which are differently disposed.

The partition portion 20 is disposed at a position so as to cover the communication aperture between the first substrate opening 11 and the cover portion opening 31. That is, in the microphone unit 1 according to the present embodiment, the first substrate internal space 35 and the cover portion internal space 32 are partitioned by the partition portion 20, so as not to be communicated with each other. In the present embodiment, since the cover portion 33 covers a part of the first substrate opening 11, the portion of the first substrate opening which is not covered with the cover portion 33 is covered with the partition portion 20.

The partition portion 20 includes a diaphragm 22 as a part thereof. The diaphragm 22 is disposed at a position so as to cover a part of the substrate opening 11. In addition, the position of the vibrating surface of the diaphragm 22 may be or may not be matched to the aperture plane of the first substrate opening 11.

The other configuration of the partition portion 20 itself is the same as that in the microphone unit 1 described with reference to FIGS. 1(A) and 1(B).

The microphone unit 3 according to the present embodiment may include the signal processing circuit 40 and the electrodes 51 to 54. The configurations of the signal processing circuit 40 and the electrodes 51 to 54 are the same as those in the microphone unit 1 described with reference to FIGS. 1(A) and 1(B).

Next, the operation of the microphone unit 3 according to the present embodiment will be described with reference to FIG. 7.

A sound pressure Pf3 of a sound wave which is incident from the fourth substrate opening 14 to reach the diaphragm 22 through the second substrate internal space 36 and the cover portion internal space 32, is incident to one side of the diaphragm 22, and a sound pressure Pb3 of a sound wave which is incident from the second substrate opening 12 to reach the diaphragm 22 through the first substrate internal space 35, is incident to the other side of the diaphragm 22. Therefore, the diaphragm 22 vibrates on the basis of a difference between the sound pressure Pf3 and the sound pressure Pb3. That is, the diaphragm 22 operates as a diaphragm for a differential microphone.

Here, in order to obtain satisfactory differential microphone characteristics, the adhesion between the microphone substrate 18 and the holding portion 24 is important. When there is an acoustic leakage between the microphone substrate 18 and the holding portion 24, it is impossible to transmit a sound pressure input from the second substrate opening 12 to the diaphragm 22, which makes it impossible to obtain satisfactory differential microphone characteristics. In the present embodiment, since all the four sides of the bottom surface (the top surface in the drawing) of the holding portion 24 holding the diaphragm 22 are closely adhered to the top surface (the bottom surface in the drawing) of the microphone substrate 18 in the first substrate opening 11, by implementation of an acoustic leakage countermeasure with a sealing material or the like onto this one surface, it is possible to obtain satisfactory differential microphone characteristics without variation, which makes it possible to obtain a microphone unit resistant to environmental changes as well.

Therefore, according to the microphone unit 3 in the present embodiment, it is possible to detect a sound pressure difference by use of sound waves at two points on the same surface of the microphone substrate 18 as inputs. Further, it is possible to realize a small-sized and lightweight microphone unit by densely mounting a differential microphone composed of one diaphragm thereon.

Further, since the second substrate opening 12 and the fourth substrate opening 14 function as sound collecting apertures, and the electrodes 51 to 54 are on the same surface side of the microphone substrate 18, it is possible to realize a microphone unit which can be disposed on the back side of the wiring board.

Moreover, the microphone unit may be configured such that a sound wave arrival time from the fourth substrate opening 14 to the diaphragm 22 and a sound wave arrival time from the second substrate opening 12 to the diaphragm 22 are made equal. The microphone unit may be configured such that a route length of a sound wave from the fourth substrate opening 14 to the diaphragm 22 and a route length of a sound wave from the second substrate opening 12 to the diaphragm 22 are made equal in order to equalize the sound wave arrival times. A route length may be, for example, a length of a line connecting centers of sections of a route. Preferably, a ratio between these route lengths is made equal by ±20% (within a range from 80% or more to 120% or less), to substantially equalize their acoustic impedances, which makes it possible to make differential microphone characteristics satisfactory especially in a high frequency band.

With this configuration, since it is possible to arrange the arrival times of sound waves, i.e., the phases reaching the diaphragm 22 from the fourth substrate opening 14 and the second substrate opening 12, it is possible to realize a further accurate noise-canceling function.

4. Microphone Unit According to a Fourth Embodiment

Figure 8:
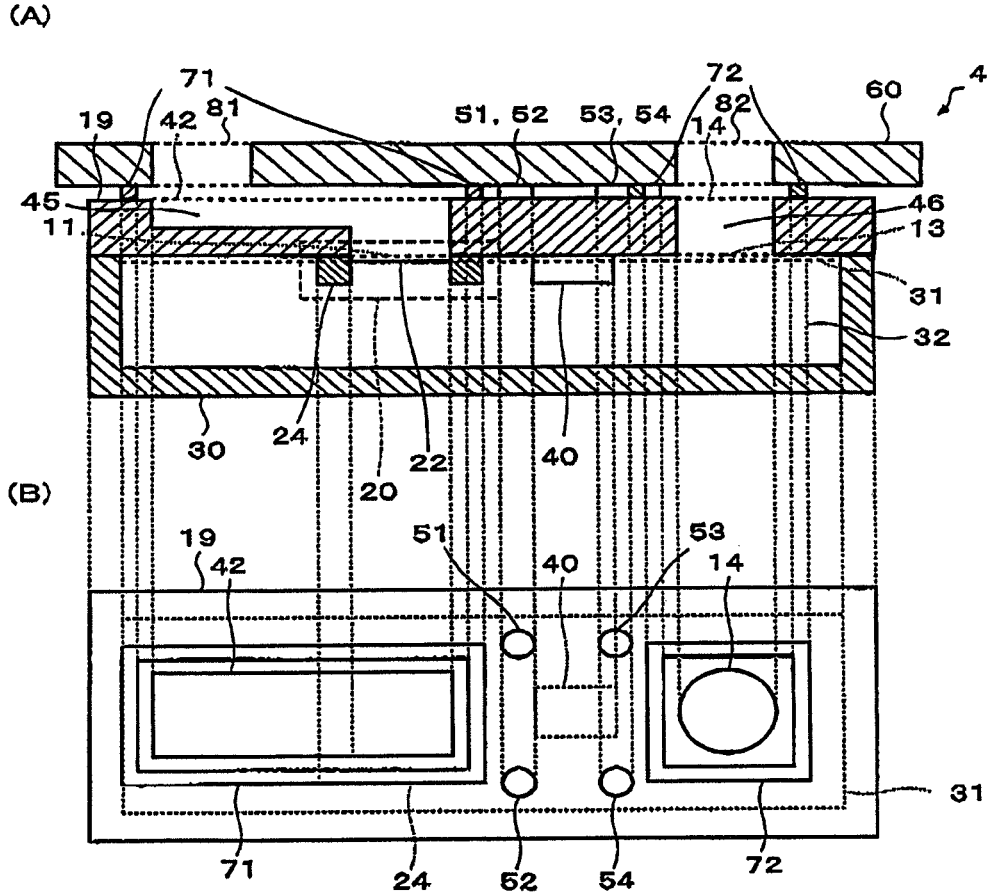
FIG. 8 are the configuration of a microphone unit according to a fourth embodiment.
Figure 9:
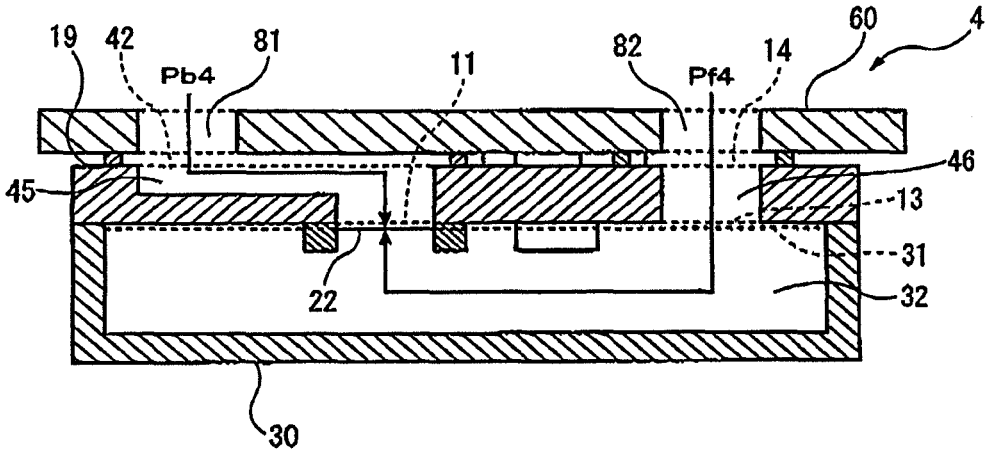
FIG. 9 is a cross sectional view for explanation of the operation of the microphone unit according to the fourth embodiment.

The configuration of a microphone unit 4 according to a fourth embodiment will be described with reference to FIGS. 8 and 9.

FIGS. 8(A) and 8(B) are views showing one example of the configuration of the microphone unit according to the present embodiment. FIG. 8(A) is a cross sectional view of the microphone unit 4 according to the present embodiment, and FIG. 8(B) is a view schematically showing a plan view of the microphone unit 4 according to the present embodiment. In addition, configurations which are the same as those in the microphone unit 1 described with reference to FIGS. 1(A) and 1(B) are attached with the same reference numerals, and detailed descriptions thereof will be omitted.

The microphone unit 4 according to the present embodiment includes a microphone substrate 19, the partition portion 20, and the cover portion 30. The configurations of the partition portion 20 and the cover portion 30 are the same as those in the microphone unit 1 described with reference to FIGS. 1(A) and 1(B).

The microphone substrate 19 has the first substrate opening 11 and the third substrate opening 13 which are provided in one surface, a second substrate opening 42 and the fourth substrate opening 14 which are provided in the other surface, and a first substrate internal space 45 and a second substrate internal space 46.

The first substrate internal space 45 is communicated with the cover portion internal space 32 via the first substrate opening 11 and the cover portion opening 31, and is communicated with the outside via the second substrate opening 42.

The second substrate internal space 46 is communicated with the cover portion internal space 32 via the third substrate opening 13 and the cover portion opening 31, and is communicated with the outside via the fourth substrate opening 14.

The shapes of the first substrate internal space 45 and the second substrate internal space 46 are not particularly limited. For example, they may be formed a rectangular parallelepiped or a cylindrical shape. Further, the shapes of the first substrate opening 11, the second substrate opening 42, the third substrate opening 13, and the fourth substrate opening 14 are not particularly limited. For example, they may be formed a circular shape or a rectangular shape. Moreover, the shapes of the third substrate opening 13 and the fourth substrate opening 14 may be respectively formed the same shape.

The first substrate internal space 45 may be provided only inside the substrate in the vertical direction of the second substrate opening 42 as in the present embodiment. Further, the second substrate internal space 46 may be provided only in the vertical direction of the third substrate opening 13 and the fourth substrate opening 14 as in the present embodiment.

In addition, the microphone substrate 19 may be formed of a material such as an insulation molding base material, sintered ceramics, glass-epoxy, or plastic. Further, the microphone substrate 19 having the first substrate internal space 45 and the second substrate internal space 46 may be, for example, manufactured by pressing a mold having a convex portion onto an insulation molding base material to form through holes thereafter, or manufactured from sintered ceramics by use of a desired mold to form through holes thereafter, or manufactured by bonding substrates having through holes which are differently disposed.

The microphone unit 4 according to the present embodiment may include the signal processing circuit 40 and the electrodes 51 to 54. The configurations of the signal processing circuit 40 and the electrodes 51 to 54 are the same as those in the microphone unit 1 described with reference to FIGS. 1(A) and 1(B).

The microphone unit 4 according to the present embodiment may be connected to a wiring board 60. The wiring board 60 includes a first through hole 81 and a second through hole 82. The wiring board 60 may be disposed at a position at which, as in the present embodiment, the first through hole 81 is communicated with the first substrate internal space 45 via the second substrate opening 42, and the second through hole 82 is communicated with the second substrate internal space 35 and the cover portion internal space 32 via the fourth substrate opening 14. The wiring board 60 holds the microphone substrate 19, and wiring and the like guiding electrical signals based on vibration of the diaphragm 22 to the other circuits and the like are formed thereon.

The microphone unit 4 according to the present embodiment may be connected to the wiring board 60, to block a part of the second substrate opening 42 with the wiring board 60.

Further, the microphone unit 4 according to the present embodiment may guide an electrical signal based on vibration of the diaphragm 22 to the wiring board 60 via the electrodes 51 to 54. In addition, FIG. 8(B) shows the four electrodes, meanwhile, the shapes and the number of the electrodes are not particularly limited.

As for the connection between the wiring board 60 and the microphone substrate 19, an area omnidirectionally surrounding the first through hole 81 on one surface of the wiring board 60 and an area omnidirectionally surrounding the second substrate opening 42 on the other surface of the microphone substrate 19 may be connected so as to face each other. For example, as in the present embodiment, a sealing portion 71 which continuously surrounds the periphery of the first through hole 81 on one surface of the wiring board 60 and continuously surrounds the periphery of the second substrate opening 42 on the other surface of the microphone substrate 19, that is for connecting the microphone substrate 19 and the wiring board 60, may be included. Thereby, it is possible to prevent speech from getting into the second substrate opening 42 from a gap between the microphone substrate 19 and the wiring board 60 (an acoustic leakage).

As for the connection between the wiring board 60 and the microphone substrate 19, an area omnidirectionally surrounding the second through hole 82 on one surface of the wiring board 60 and an area omnidirectionally surrounding the fourth substrate opening 14 on the other surface of the microphone substrate 19 may be connected so as to face each other. For example, as in the present embodiment, a sealing portion 72 which continuously surrounds the periphery of the second through hole 82 on one surface of the wiring board 60 and continuously surrounds the periphery of the fourth substrate opening 14 on the other surface of the microphone substrate 19, that is for connecting the microphone substrate 19 and the wiring board 60, may be included. Thereby, it is possible to prevent speech from getting into the second substrate opening 12 from a gap between the microphone substrate 19 and the wiring board 60 (an acoustic leakage).

The sealing portions 71 and 72 may be formed of, for example, solder. Further, the sealing portions 71 and 72 may be formed of, for example, an electrically conductive adhesive such as silver paste, or an adhesive which is not particularly electrically conductive. Further, the sealing portions 71 and 72 may be formed of, for example, a material such as a peel-off sticker, which is capable of securing airtightness.

Here, since the microphone 19 is configured to secure the first substrate internal space 45 by blocking a part of the second substrate opening 42 by use of the wiring board 60, a member for sealing the top portion of the first substrate internal space 45 as the members in the microphone substrate 17 described in the second embodiment and the microphone substrate 18 described in the third embodiment is made unnecessary. Therefore, it is possible to suppress the thickness of the microphone substrate 19, which makes it possible to realize the thin microphone unit 4.

Next, the operation of the microphone unit 4 according to the present embodiment will be described with reference to FIG. 9.

A sound pressure Pf4 of a sound wave which is incident from the fourth substrate opening 14 to reach the diaphragm 22 through the second substrate internal space 46 and the cover portion internal space 32, is incident to one side of the diaphragm 22, and a sound pressure Pb4 of a sound wave which is incident from the second substrate opening 42 to reach the diaphragm 22 through the first substrate internal space 35, is incident to the other side of the diaphragm 22. Therefore, the diaphragm 22 vibrates on the basis of a difference between the sound pressure Pf4 and the sound pressure Pb4. That is, the diaphragm 22 operates as a diaphragm for a differential microphone.

Here, in order to obtain satisfactory differential microphone characteristics, the adhesion between the microphone substrate 19 and the holding portion 24 is important. When there is an acoustic leakage between the microphone substrate 19 and the holding portion 24, it is impossible to transmit a sound pressure input from the second substrate opening 12 to the diaphragm 22, which makes it impossible to obtain satisfactory differential microphone characteristics. In the present embodiment, since all the four sides of the bottom surface (the top surface in the drawing) of the holding portion 24 holding the diaphragm 22 are closely adhered to the top surface (the bottom surface in the drawing) of the microphone substrate 19 in the first substrate opening 11, by implementation of an acoustic leakage countermeasure with a sealing material or the like onto this one surface, it is possible to obtain satisfactory differential microphone characteristics without variation, which makes it possible to obtain a microphone unit resistant to environmental changes as well.

Therefore, according to the microphone unit 4 in the present embodiment, it is possible to detect a sound pressure difference by use of sound waves at two points on the same surface of the microphone substrate 19 as inputs. Further, it is possible to realize a small-sized and lightweight microphone unit by densely mounting a differential microphone composed of one diaphragm thereon.

Further, since the second substrate opening 42 and the fourth substrate opening 14 function as sound collecting apertures, and the electrodes 51 to 54 are on the same surface side of the microphone substrate 19, it is possible to realize a microphone unit which can be disposed on the back side of the wiring board.

Moreover, the microphone unit may be configured such that a sound wave arrival time from the fourth substrate opening 14 to the diaphragm 22 and a sound wave arrival time from the second substrate opening 42 to the diaphragm 22 are made equal. The microphone unit may be configured such that a route length of a sound wave from the fourth substrate opening 14 to the diaphragm 22 and a route length of a sound wave from the second substrate opening 42 to the diaphragm 22 are made equal in order to equalize the sound wave arrival times. A route length may be, for example, a length of a line connecting centers of sections of a route. Preferably, a ratio between these route lengths is made equal by ±20% (within a range from 80% or more to 120% or less), to substantially equalize their acoustic impedances, which makes it possible to make differential microphone characteristics satisfactory especially in a high frequency band.

With this configuration, since it is possible to arrange the arrival times of sound waves, i.e., the phases reaching the diaphragm 22 from the fourth substrate opening 14 and the second substrate opening 42, it is possible to realize a further accurate noise-canceling function.

The present invention contains configurations substantially the same as the configurations described in the embodiments (for example, configurations which are the same in function, method and result, or configurations which are the same in object and effect). Further, the present invention contains configurations in which unessential portions in the configurations described in the embodiments are replaced. Further, the present invention contains configurations with which it is possible to perform the same actions and effects or configurations with which it is possible to achieve the same object as the configurations described in the embodiments. Further, the present invention contains configurations in which publicly known technologies are added to the configurations described in the embodiments.

For example, the microphone units 1 to 3 described in the first to third embodiments as well may be configured so as to be connected to a wiring board having two through holes in the same way as in the microphone unit 4 described in the fourth embodiment.

In addition, it is preferable that an interval between the first cover portion opening 11 and the third cover portion opening 13 is made less than or equal to 5.2 mm, which makes it possible to realize a differential microphone having excellent distant noise suppressing characteristics.

Further, as for the microphone units 1 to 3 described in the first to third embodiments, an area ratio between the first cover portion opening 11 and the third cover portion opening 13 is made equal by ±20% (within a range from 80% or more to 120% or less), to substantially equalize their acoustic impedances, which makes it possible to make differential microphone characteristics satisfactory especially in a high frequency band.

Moreover, a volume ratio between a volume of the first substrate internal space 15 (25; 35; 45) and a sum of the volumes of the second substrate internal space 16 (26; 36; 46) and the cover portion internal space 32 is made equal by ±50% (within a range from 50% or more to 150% or less), to substantially equalize their acoustic impedances, which makes it possible to make differential microphone characteristics satisfactory especially in a high frequency band.

The invention claimed is:

1. A microphone unit comprising:

a microphone substrate;

a partition portion including a diaphragm; and a cover portion which covers one surface side of the microphone substrate, wherein:

the cover portion has a cover portion opening provided in one surface, and a cover portion internal space communicating with an outside of the cover portion via the cover portion opening, the microphone substrate has a first substrate opening and a third substrate opening which are provided in one surface, a second substrate opening and a fourth substrate opening which are provided in the other surface, and a first substrate internal space and a second substrate internal space, the first substrate internal space is communicated with the cover portion internal space via the first substrate opening and the cover portion opening, and is communicated with an outside of the microphone unit via the second substrate opening, the second substrate internal space is communicated with the cover portion internal space via the third substrate opening and the cover portion opening, and is communicated with the outside of the microphone unit via the fourth substrate opening, the partition portion covers a communication aperture between the first substrate opening and the cover portion opening, and the diaphragm covers at least a part of the communication aperture between the first substrate opening and the cover portion opening.

2. The microphone unit according to claim 1, wherein the cover portion internal space is provided in a direction vertical to a surface plane of the cover portion opening.

3. The microphone unit according to claim 1, wherein the first substrate internal space is provided in a direction vertical to a surface plane of the first substrate opening.

4. The microphone unit according to claim 1, wherein the first substrate internal space is provided in a direction vertical to a surface plane of the second substrate opening.

5. The microphone unit according to claim 1, wherein:

the first substrate internal space is provided at a position at which the first substrate internal space in not overlapped with a direction vertical to a surface plane of the second substrate opening, and the second substrate opening is provided at a position at which the second substrate opening is not overlapped with a direction vertical to a surface plane of the first substrate opening.

6. The microphone unit according to claim 1, further comprising a signal processing circuit disposed on one surface side of the microphone substrate inside the cover portion internal space.

7. The microphone unit according to claim 6, further comprising an electrode unit electrically connected to the signal processing circuit on the other surface side of the microphone substrate.

8. The microphone unit according to claim 1, wherein a route length of a sound wave from the second substrate opening to the diaphragm and a route length of a sound wave from the fourth substrate opening to the diaphragm is equal such that a sound wave arrival time from the second substrate opening to the diaphragm is equal to a sound wave arrival time from the fourth substrate opening to the diaphragm.

9. The microphone unit according to claim 1, further comprising a wiring board having a first through hole and a second through hole, wherein the wiring board is disposed at a position at which the first through hole is communicated with the first substrate internal space via the second substrate opening, and the second through hole is communicated with the second substrate internal space and the cover portion internal space via the fourth substrate opening.

10. The microphone unit according to claim 9, wherein:

an area surrounding the first through hole on one surface of the wiring board and an area surrounding the second opening on the other surface of the microphone substrate are connected so as to face each other, and an area surrounding the second through hole on one surface of the wiring board and an area surrounding the fourth opening portion on the other surface of the microphone substrate are connected so as to face each other.

* * * * *